US010288056B2

(12) United States Patent
Alpha et al.

(10) Patent No.: US 10,288,056 B2
(45) **Date of Patent: *May 14, 2019**

(54) DISCHARGE GAS MANIFOLD FOR USE WITH MULTIPLE COMPRESSORS

(71) Applicant: Carrier Corporation, Palm Beach Gardens, FL (US)

(72) Inventors: Kevin Alpha, Weedsport, NY (US); Eugene Duane Daddis, Jr., Manlius, NY (US); Stephen C. Inglis, Kirkville, NY (US); Robert A. Purdy, Fayetteville, NY (US)

(73) Assignee: CARRIER CORPORATION, Farmington, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/797,050

(22) Filed: Oct. 30, 2017

(65) Prior Publication Data

US 2018/0051920 A1 Feb. 22, 2018

Related U.S. Application Data

(63) Continuation of application No. 14/216,093, filed on Mar. 17, 2014, now Pat. No. 9,869,497.

(60) Provisional application No. 61/807,873, filed on Apr. 3, 2013.

(51) Int. Cl.

| | |
|---|---|
| ***F04B 41/06*** | (2006.01) |
| ***F25B 31/02*** | (2006.01) |
| ***F25B 41/00*** | (2006.01) |

(52) U.S. Cl.

CPC ..... *F04B 41/06* (2013.01); *F25B 31/02* (2013.01); *F25B 41/003* (2013.01); *F25B 2400/075* (2013.01); *F25B 2500/01* (2013.01); *Y10S 417/902* (2013.01)

(58) Field of Classification Search

CPC .... F25B 2400/075; F25B 31/02; F04B 41/06; F04C 23/001

USPC ..... 417/902

See application file for complete search history.

(56) References Cited

U.S. PATENT DOCUMENTS

| | | | |
|---|---|---|---|
| 3,237,852 | A | 3/1966 | Shaw |
| 3,820,921 | A | 6/1974 | Thayer |
| 4,179,248 | A | 12/1979 | Shaw |
| 4,383,802 | A | 5/1983 | Gianni et al. |
| 4,418,548 | A | 12/1983 | Sawyer |
| 5,277,554 | A | 1/1994 | Elson |

(Continued)

FOREIGN PATENT DOCUMENTS

| | | | |
|---|---|---|---|
| FR | 1414452 | A | 10/1965 |
| WO | 2012056150 | A2 | 5/2012 |
| WO | 2012080611 | A1 | 6/2012 |

OTHER PUBLICATIONS

Norton, Michael, and Karczub, Denis, "Fundamentals of Noise Vibration Analysis for Engineers", Book, 2013, pp. 7, 8, 443, Cambridge, Press, NY, NYC.

(Continued)

*Primary Examiner* — Peter J Bertheaud

(74) *Attorney, Agent, or Firm* — Cantor Colburn LLP

(57) ABSTRACT

A discharge gas manifold having a main conduit, an end feeder conduit, and at least one intermediate feeder conduit, wherein the at least one intermediate feeder conduit contains a portion, adjacent to the main conduit, that forms an angle between 0°-60° with the axis of the main conduit.

17 Claims, 3 Drawing Sheets

(56) References Cited

U.S. PATENT DOCUMENTS

| | | | | |
|---|---|---|---|---|
| 5,385,453 | A | 1/1995 | Fogt et al. | |
| 6,948,916 | B2 | 9/2005 | Hebert | |
| 6,983,622 | B2 * | 1/2006 | De Bernardi ..... | F25B 31/002 184/6.16 |
| 7,165,419 | B2 | 1/2007 | Song et al. | |
| 7,213,406 | B2 | 5/2007 | Decourioux et al. | |
| 8,118,563 | B2 | 2/2012 | Chen et al. | |
| 9,869,497 | B2 * | 1/2018 | Alpha ..... | F25B 41/003 |
| 2012/0017636 | A1 | 1/2012 | Wada et al. | |

OTHER PUBLICATIONS

Wachel, J.C., et al., "Piping Vibration Analysis, Symposium", Proceeding of 19th Turbo Machenery Symposium, 1990, College Station TX.

* cited by examiner

DISCHARGE GAS MANIFOLD FOR USE WITH MULTIPLE COMPRESSORS

CROSS REFERENCE TO RELATED APPLICATIONS

The present application is a continuation of U.S. application Ser. No. 14/216,093, filed Mar. 17, 2014, which claims the priority benefit of U.S. Provisional Patent Application No. 61/807,873 filed Apr. 3, 2013, the contents of which are hereby incorporated in their entirety into the present disclosure.

TECHNICAL FIELD OF THE DISCLOSED EMBODIMENTS

The presently disclosed embodiments generally relate to heating and cooling components. More particularly, the embodiments relate to a discharge manifold for use with multiple compressors.

BACKGROUND OF THE DISCLOSED EMBODIMENTS

In some commercial HVAC applications, an HVAC system may utilize multiple compressors in a parallel configuration that work together to satisfy the refrigeration load. The multiple compressors employ a common suction line and a common discharge line to circulate refrigerant gas through the HVAC system. A discharge gas manifold may be provided to operatively connect the multiple compressors to the common discharge line. In some instances, the discharge gas manifold requires extra bracketing to keep the discharge gas manifold from moving due to significant vibration levels of the refrigerant gas entering the main conduit of the discharge gas manifold. Such extra bracketing adds expense to the system. Thus, there is a desire for a discharge gas manifold that can be coupled to multiple refrigeration compressors that does not require extra bracketing, and reduces the vibration levels of the refrigerant gas entering the main conduit of the discharge gas manifold.

SUMMARY OF THE DISCLOSED EMBODIMENTS

In one aspect, an HVAC component is provided. The HVAC component includes at least two refrigeration compressors. The HVAC component includes a gas manifold operably coupled to each of the refrigeration compressors to allow a discharged gas to flow therethrough.

In one aspect, a gas manifold utilized on the discharge line of an HVAC component with a parallel compressor configuration is provided. The discharge gas manifold includes a main conduit having a distal, and a proximal end. The discharge gas manifold includes an end feeder conduit extending from the distal end of the main conduit. The space inside of the end feeder conduit is in communication with the space inside of the main conduit. The end feeder conduit also includes a portion which forms an angle between 0°-60° with the axis of the main conduit. The discharge gas manifold also includes at least one intermediate feeder conduit extending from an area between the distal end and the proximal end of the main conduit. The space inside each of the intermediate feeder conduits is in communication with the space inside of the main conduit. Each of the intermediate feeder conduits further includes a portion, having a longitudinal axis, which forms an angle between 0°-60° with the longitudinal axis of the main conduit.

BRIEF DESCRIPTION OF THE DRAWINGS

The embodiments and other features, advantages and disclosures contained herein, and the manner of attaining them, will become apparent and the present disclosure will be better understood by reference to the following description of various exemplary embodiments of the present disclosure taken in conjunction with the accompanying drawing, wherein.

DETAILED DESCRIPTION OF THE DRAWINGS

Figure 1:
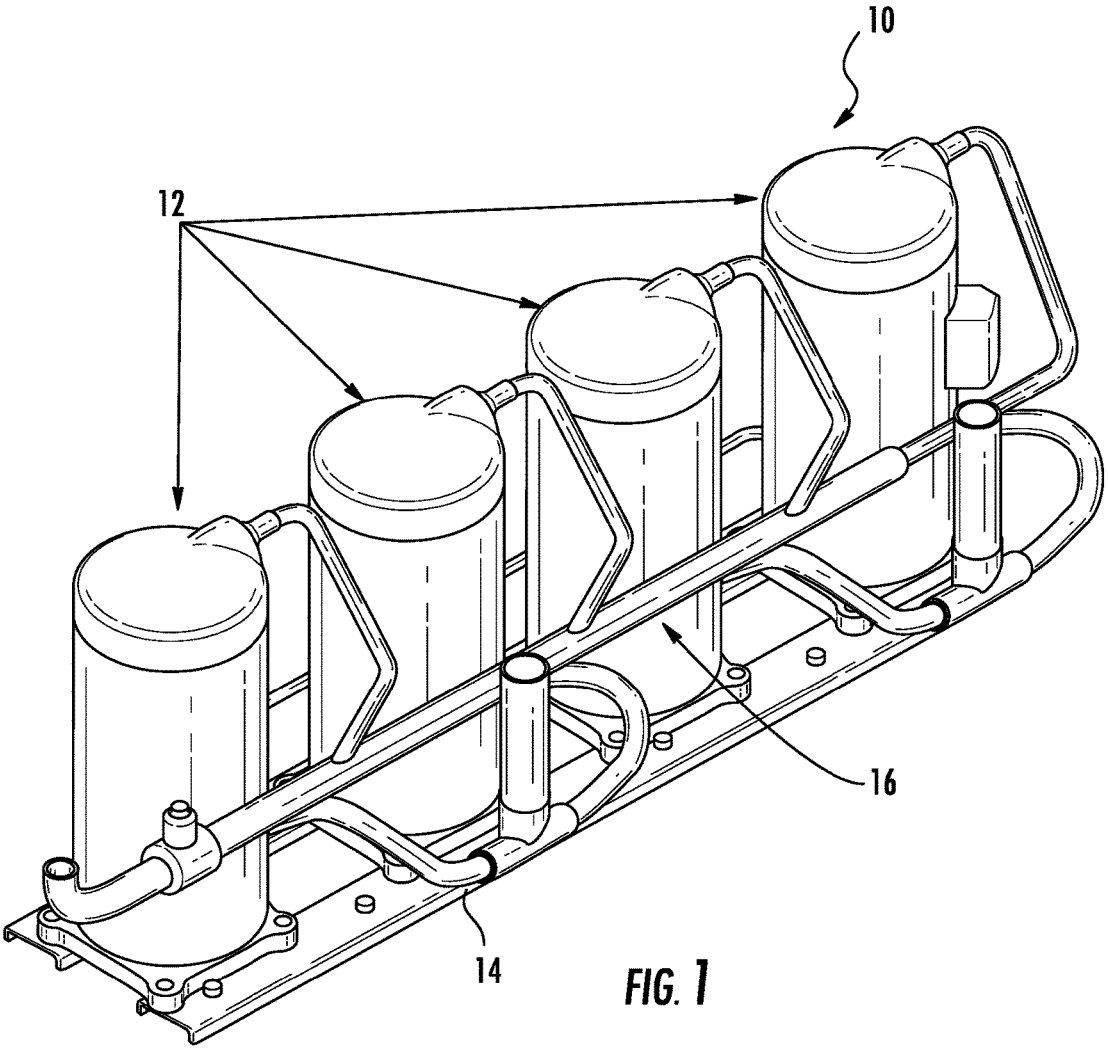
FIG. 1 illustrates an HVAC component having four refrigeration compressors and utilizing a discharge gas manifold according to one embodiment of the present disclosure.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

FIG. 1 illustrates an embodiment of an HVAC component, generally indicated at 10. The HVAC component 10 includes at least two refrigeration compressors 12. For the purposes of illustration, the HVAC component 10 in the embodiment includes four refrigeration compressors 12. During typical operation of the refrigeration compressors 12, a low-pressure, low-temperature refrigerant gas enters each of the refrigeration compressors 12 via a suction line 14. The refrigerant gas flows through each of the refrigeration compressors 12, wherein each refrigeration compressor 12 converts the refrigerant gas to a high-temperature, high-pressure refrigerant gas. The high-temperature, high-pressure refrigerant gas exits the refrigeration compressors 12 through a discharge gas manifold 16 operably coupled to each of the refrigeration compressors 12. The high-temperature, high-pressure refrigerant gas flows through the discharge gas manifold 16 and flows through the remaining part of a HVAC system (not shown) to aid in conditioning air in an interior space.

Figure 2:
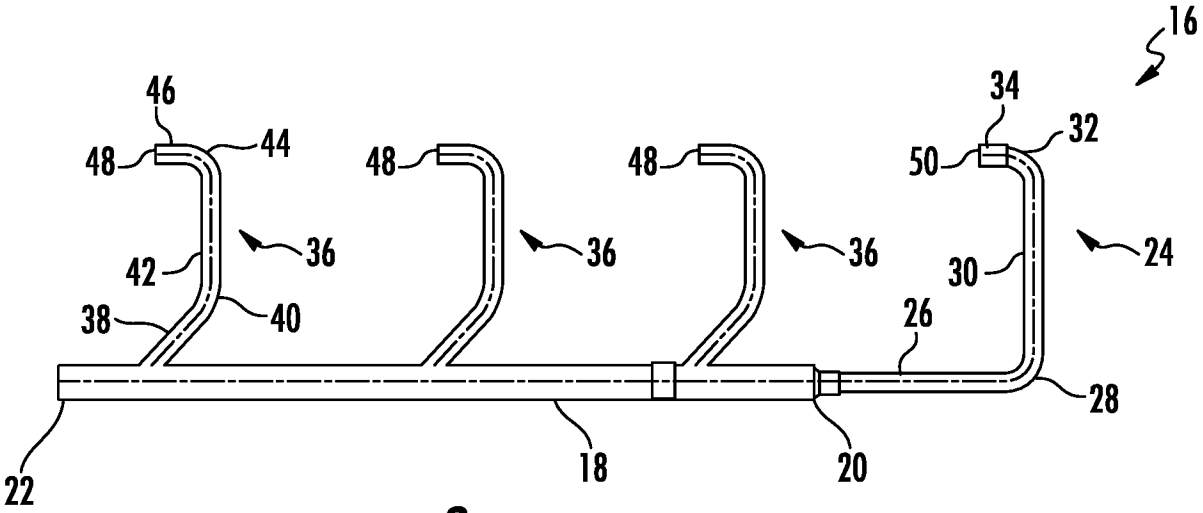
FIG. 2 schematically illustrates an exemplary embodiment of a discharge gas manifold of the present disclosure.

FIG. 2 illustrates an embodiment of the discharge gas manifold 16 for an arrangement using four refrigeration compressors 12. The discharge gas manifold 16 includes a main conduit 18 having a distal end 20 and a proximal end 22. The proximal end 22 of the discharge gas manifold 16 is operably coupled to a different HVAC component (not shown) to route the high-temperature, high pressure refrigerant gas to other parts of the HVAC system (not shown). The discharge gas manifold 16 also includes an end feeder conduit 24 extending from the main conduit 18 at distal end 20. The space inside of the end feeder conduit 24 is in communication with the space inside of the main conduit 18.

The end feeder conduit 24 includes an end first portion 26 extending from the distal end 20 of the main conduit 18. In an exemplary embodiment, the end first portion 26 is coaxial with the longitudinal axis of the main conduit 18. In other embodiments, the end first portion 26 may form an angle with respect to the longitudinal axis of the main conduit 18. The end feeder conduit 24 includes an end second straight portion 30, which forms an angle with the longitudinal axis of the end first portion 26. In an exemplary embodiment, the end second straight portion 30 is substantially perpendicular to the longitudinal axis of the end first portion 26. The end feeder conduit 24 includes an end third straight portion 34, which forms an angle with the longitudinal axis of the end second straight portion 30. In an exemplary embodiment, the end third straight portion 34 is substantially perpendicular to the longitudinal axis of the end second straight portion 30. The end third straight portion 34, of the end feeder conduit 24, is operably coupled to a discharge line of at least one of the refrigeration compressors 12. The end feeder conduit 24 includes an end first curved portion 28 joining the end first portion 26 and the end second straight portion 30. The end feeder conduit 24 includes an end second curved portion 32 joining the end second straight portion 30 and the end third straight portion 34.

The discharge gas manifold 16 also includes at least one intermediate feeder conduit 36 extending from an area between the distal end 20 and the proximal end 22 of the main conduit 18. The space inside each of the intermediate feeder conduits 36 is in communication with the space inside of the main conduit 18. Each of the intermediate feeder conduits 36 includes an intermediate first straight portion 38, having a longitudinal axis, which forms an angle between 0°-60° with the longitudinal axis of the main conduit 18. The intermediate first straight portion 38 is adjacent to the main conduit 18. In other embodiments, the intermediate first straight portion 38 forms an angle between 0°-45° with the longitudinal axis of the main conduit 18. Each of the intermediate feeder conduits 36 includes an intermediate second straight portion 42 which forms an angle with the longitudinal axis of the main conduit 18. In an exemplary embodiment, the intermediate second straight portion 42 is substantially perpendicular to the longitudinal axis of the main conduit 18. Each of the intermediate feeder conduits 36 includes an intermediate third straight portion 46 which forms an angle with the longitudinal axis of the intermediate second straight portion 42. The third straight portion 46 is substantially perpendicular to the longitudinal axis of the intermediate second straight portion 42. In an exemplary embodiment, the intermediate third straight portion 46, of each of the intermediate feeder conduits 36, is operably coupled to a discharge line of at least one of the refrigeration compressors 12. Each of the intermediate feeder conduits 36 includes an intermediate first curved portion 40 joining the intermediate first straight portion 38 and the intermediate second straight portion 42. Each of the intermediate feeder conduits 36 includes an intermediate second curved portion 44 joining the intermediate second straight portion 42 and the intermediate third straight portion 46.

During typical operation, the high-temperature, high-pressure refrigerant gas exits each of the refrigeration compressors 12 and enters an inlet 48 of a respective one of the intermediate feeder conduits 36, or an inlet 50 of the end feeder conduit 24. The high-temperature, high-pressure refrigerant gas flows through the intermediate first straight portion 38, of each of the intermediate feeder conduits 36, and flows through the end first curved portion 28, of the end feeder conduit 24 to enter the main conduit 18. The high-temperature, high-pressure refrigerant gas then flows through the main conduit 18 to the different HVAC components (not shown) that form parts of the HVAC system (not shown)

Because the high-temperature, high-pressure refrigerant gas enters the main conduit 18 through an intermediate feeder conduit 36 having an intermediate first straight portion 38 that forms an angle between 0°-60° with the longitudinal axis of the main conduit 18, the gas flow is not introduced at a substantially 90° angle to the flow of gas within the main conduit 18 as is the case in prior art systems. Turbulent flow at this juncture is therefore reduced by introducing the high-temperature, high-pressure refrigerant gas into the main conduit 18 through an intermediate feeder conduit 36 having an intermediate first straight portion 38 that forms an angle between 0°-60° with the longitudinal axis of the main conduit 18. By reducing such turbulence, vibration and the need for extra bracketing will be reduced. It will be appreciated that the geometry of each of the intermediate feeder conduits 36 may take any form from the inlet 48 to the intermediate first straight portion 38 to promote the flow of gas to the main conduit 18.

Figure 3:
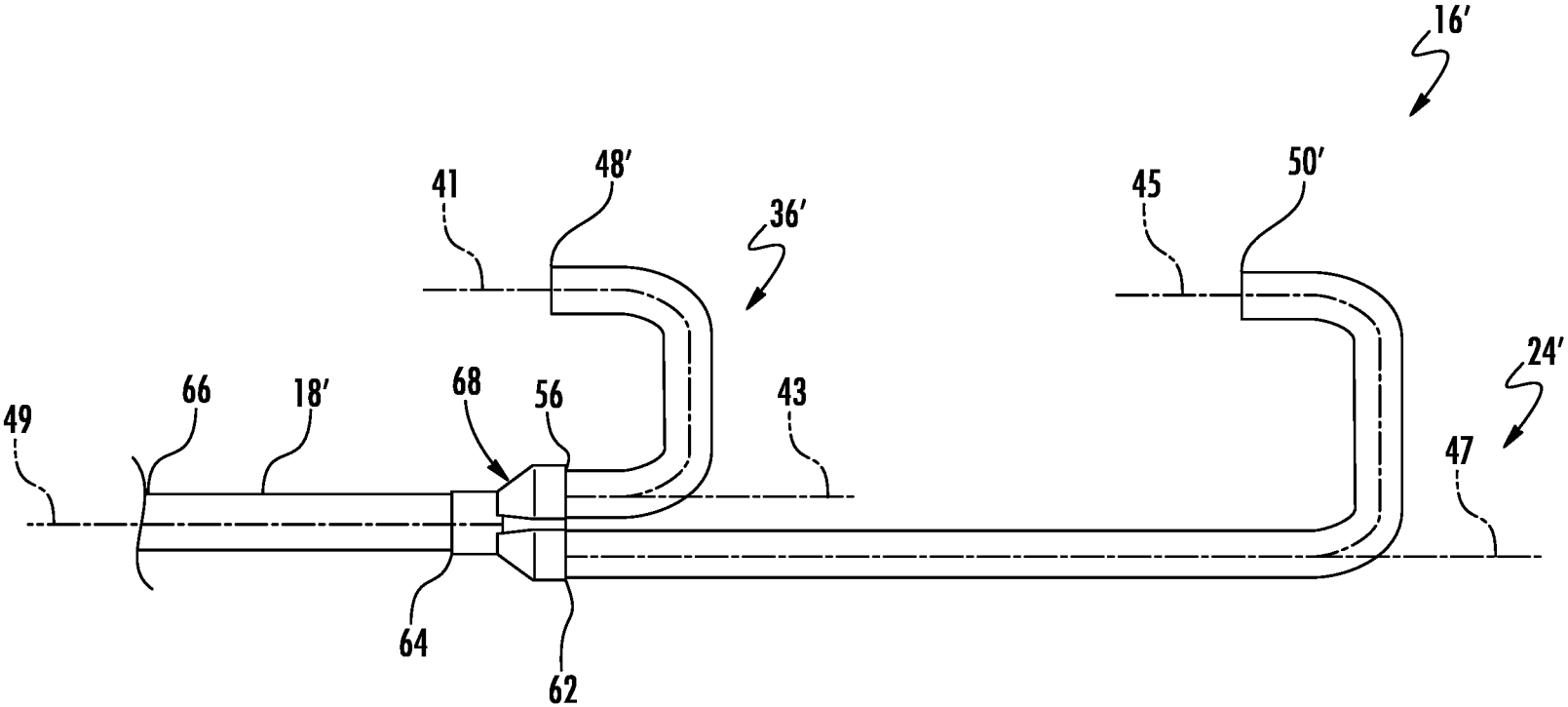
FIG. 3 schematically illustrates another embodiment of a discharge gas manifold of the present disclosure.

FIG. 3 illustrates another embodiment of the discharge gas manifold 16'. The discharge gas manifold 16' includes an intermediate feeder conduit 36' including an intermediate feeder conduit inlet 48' and an intermediate feeder conduit outlet 56; wherein a flow enters the intermediate feeder conduit 36' on an intermediate feeder conduit first flow axis 41; and wherein the intermediate feeder conduit bends such that refrigerant gas flows on an intermediate feeder conduit second flow axis 43. The discharge gas manifold 16' further includes an end feeder conduit 24' including an end feeder conduit inlet 50' and an end feeder conduit outlet 62, wherein a flow enters the end feeder conduit 24' on an end feeder conduit first flow axis 45; and wherein the intermediate feeder conduit bends such that refrigerant gas flows on an end feeder conduit second flow axis 47. The discharge gas manifold 16' further includes a main conduit 18' including a main conduit inlet 64 and a main conduit outlet 66, which further includes a main conduit flow axis 49, wherein the main conduit flow axis 49 is substantially parallel to the intermediate feeder conduit second flow axis 43 and end feeder conduit second flow axis 47. The discharge gas manifold 16' further includes a coupler 68 joining the intermediate feeder conduit outlet 56 and end feeder conduit outlet 62 to the main conduit inlet 64 such that the main conduit flow axis 49 is substantially parallel to the intermediate feeder conduit second flow axis 43 and end feeder conduit second flow axis 47. The intermediate feeder conduit inlet 48' and the end feeder conduit inlet 50' are coupled to discharge lines of their respective compressors (not shown). As high-temperature, high-pressure refrigerant gas enters inlet 48' of the intermediate feeder conduits 36', or inlet 50' of the end feeder conduit 24', it flows through the respective conduits wherein it enters coupler 68. The high-temperature, high-pressure refrigerant gas flows through the coupler 68 wherein the coupler 68 directs the gas into main conduit 18'. It will be appreciated that additional couplers 68 may be added to either the intermediate feeder conduit 36', or main conduit 18' to accommodate a number of compressor configurations.

Because the high-temperature, high-pressure refrigerant gas enters the main conduit 18' through an intermediate feeder conduit 36' and end feeder conduit 24' at an angle which is substantially parallel to the main conduit flow axis 49 the gas flow is not introduced at a substantially 90° angle to the flow of gas within the main conduit 18' as is the case in prior art systems. The coupler 68 will redirect each flow of gas toward the main conduit flow axis 49 in a reduced turbulence manner because the flow axes 43 and 47 are parallel to (and positioned close to) the main conduit flow axis 49. Turbulent flow at this juncture is therefore reduced by introducing the high-temperature, high-pressure refrigerant gas into the main conduit 18' through an intermediate feeder conduit 36' and end feeder conduit 24' each having a respective second flow axis that is substantially parallel to the main conduit flow axis By reducing such turbulence, vibration and the need for extra bracketing will be reduced.

While the invention has been illustrated and described in detail in the drawings and foregoing description, the same is to be considered as illustrative and not restrictive in character, it being understood that only certain embodiments have been shown and described and that all changes and modifications that come within the spirit of the invention are desired to be protected.

What is claimed is:

1. An HVAC component comprising:

at least two refrigeration compressors;

a discharge gas manifold further comprising:

a main conduit having a distal end, a proximal end, and a main longitudinal axis; and at least one intermediate feeder conduit having a first portion extending from an area between the distal end and the proximal end of the main conduit and having a second portion operably coupled between the first portion and a discharge line of at least one of the compressors;

wherein the first portion of the at least one intermediate feeder conduit, including an intermediate portion longitudinal axis, is directly connected to the main conduit and forms an angle between 0°-45° with the main longitudinal axis.

2. The HVAC component of claim 1, wherein the first portion of the at least one intermediate feeder conduit is an intermediate first straight portion.

3. The HVAC component of claim 2, wherein the second portion of the at least one intermediate feeder conduits further comprises:

an intermediate first curved portion, adjacent to the intermediate first straight portion;

an intermediate second straight portion adjacent to the intermediate first curved portion, the intermediate second straight portion including an intermediate second straight portion longitudinal axis forming an angle with the main longitudinal axis;

an intermediate second curved portion, adjacent to the intermediate second straight portion; and an intermediate third straight portion adjacent to the intermediate second curved portion, the intermediate third straight portion including an intermediate third straight portion longitudinal axis forming an angle with the main longitudinal axis.

4. The HVAC component of claim 1, further comprising an end feeder conduit, wherein the end feeder conduit comprises:

an end first straight portion extending from the distal end of the main conduit, the end first straight portion including an end first straight portion longitudinal axis;

an end first curved portion adjacent to the end first straight portion;

an end second straight portion adjacent to the end first curved portion and including an end second straight portion longitudinal axis forming an angle with the end first straight portion longitudinal axis;

an end second curved portion adjacent to the end second straight portion; and an end third straight portion adjacent to the end second curved portion, the end third straight portion including an end third straight portion longitudinal axis forming an angle with the end second straight portion longitudinal axis;

wherein the end third straight portion is operably coupled to the discharge line of at least one of the refrigeration compressors.

5. The HVAC component of claim 4, wherein the end second straight portion longitudinal axis is substantially perpendicular to the end first straight portion longitudinal axis.

6. An HVAC component comprising:

at least two refrigeration compressors;

a discharge gas manifold further comprising:

a main conduit having a distal end, a proximal end, and a main longitudinal axis; and at least one intermediate feeder conduit having a first portion extending from an area between the distal end and the proximal end of the main conduit and having a second portion operably coupled between the first portion and a discharge line of at least one of the compressors;

wherein the first portion of the at least one intermediate feeder conduit, including an intermediate portion longitudinal axis, is directly connected to the main conduit and forms an angle between 0°-60° with the main longitudinal axis.

7. The HVAC component of claim 6, further comprising an end feeder conduit, wherein the end feeder conduit comprises:

an end first straight portion extending from the distal end of the main conduit, the end first straight portion including an end first straight portion longitudinal axis;

an end first curved portion adjacent to the end first straight portion;

an end second straight portion adjacent to the end first curved portion and including an end second straight portion longitudinal axis forming an angle with the end first straight portion longitudinal axis;

an end second curved portion adjacent to the end second straight portion; and an end third straight portion adjacent to the end second curved portion, the end third straight portion including an end third straight portion longitudinal axis forming an angle with the end second straight portion longitudinal axis;

wherein the end third straight portion is operably coupled to the discharge line of at least one of the refrigeration compressors.

8. The HVAC component of claim 7, wherein the end second straight portion longitudinal axis is substantially perpendicular to the end first straight portion longitudinal axis.

9. The HVAC component of claim 7, wherein the end third straight portion longitudinal axis is substantially perpendicular to the end second straight portion longitudinal axis.

10. The HVAC component of claim 6, wherein the first portion of the at least one intermediate feeder conduit is an intermediate first straight portion;

wherein the second portion of the at least one intermediate feeder conduit further comprises:

an intermediate first curved portion, adjacent to the intermediate first straight portion;

an intermediate second straight portion adjacent to the intermediate first curved portion, the intermediate second straight portion including an intermediate second straight portion longitudinal axis forming an angle with the main longitudinal axis;

an intermediate second curved portion, adjacent to the intermediate second straight portion; and an intermediate third straight portion adjacent to the intermediate second curved portion, the intermediate third straight portion including an intermediate third straight portion longitudinal axis forming an angle with the main longitudinal axis;

wherein the intermediate second straight portion longitudinal axis is substantially perpendicular to the main longitudinal axis; and wherein the intermediate third straight portion longitudinal axis is substantially perpendicular to the intermediate second straight portion longitudinal axis.

11. A discharge gas manifold comprising:

a main conduit having a distal end, a proximal end, and a main longitudinal axis;

and at least one intermediate feeder conduit extending from an area between the distal end and the proximal end of the main conduit;

wherein a portion of the at least one intermediate feeder conduit most proximal to the main conduit, including an intermediate portion longitudinal axis, forms an angle between 0°-45° with the main longitudinal axis;

wherein a first portion of the at least one intermediate feeder conduit is an intermediate first straight portion;

wherein a second portion of the at least one intermediate feeder conduits further comprises:

an intermediate first curved portion, adjacent to the intermediate first straight portion;

an intermediate second straight portion adjacent to the intermediate first curved portion, the intermediate second straight portion including an intermediate second straight portion longitudinal axis forming an angle with the main longitudinal axis;

an intermediate second curved portion, adjacent to the intermediate second straight portion; and an intermediate third straight portion adjacent to the intermediate second curved portion, the intermediate third straight portion including an intermediate third straight portion longitudinal axis forming an angle with the intermediate second straight portion.

12. The discharge gas manifold of claim 11, further comprising an end feeder conduit, wherein the end feeder conduit comprises:

an end first straight portion extending from the distal end of the main conduit, the end first straight portion including an end first straight portion longitudinal axis;

an end first curved portion adjacent to the end first straight portion;

an end second straight portion adjacent to the end first curved portion and including an end second straight portion longitudinal axis forming an angle with the end first straight portion longitudinal axis;

an end second curved portion adjacent to the end second straight portion; and an end third straight portion adjacent to the end second curved portion, the end third straight portion including an end third straight portion longitudinal axis forming an angle with the end second straight portion longitudinal axis;

wherein the end third straight portion is operably coupled to the discharge line of at least one of the refrigeration compressors.

13. The discharge gas manifold of claim 12, wherein the end second straight portion longitudinal axis is substantially perpendicular to the end first straight portion longitudinal axis.

14. A discharge gas manifold comprising:

a main conduit having a distal end, a proximal end, and a main longitudinal axis;

at least one intermediate feeder conduit having a first portion extending from an area between the distal end and the proximal end of the main conduit and having a second portion operably coupled between the first portion and a discharge line of at least one compressor;

wherein the first portion of the at least one intermediate feeder conduit, including an intermediate portion longitudinal axis, is directly connected to the main conduit and forms an angle between 0°-60° with the main longitudinal axis.

15. The discharge gas manifold of claim 14, further comprising an end feeder conduit, wherein the end feeder conduit comprises:

an end first straight portion extending from the distal end of the main conduit, the end first straight portion including an end first straight portion longitudinal axis;

an end first curved portion adjacent to the end first straight portion;

an end second straight portion adjacent to the end first curved portion and including an end second straight portion longitudinal axis forming an angle with the end first straight portion longitudinal axis;

an end second curved portion adjacent to the end second straight portion; and an end third straight portion adjacent to the end second curved portion, the end third straight portion including an end third straight portion longitudinal axis forming an angle with the end second straight portion longitudinal axis.

16. The discharge gas manifold of claim 15, wherein the end second straight portion longitudinal axis is substantially perpendicular to the end first straight portion longitudinal axis.

17. The discharge gas manifold of claim 15, wherein the end third straight portion longitudinal axis is substantially perpendicular to the end second straight portion longitudinal axis.

* * * * *